United States Patent [19]

Bennett, Sr.

[11] 4,365,596

[45] Dec. 28, 1982

[54] ENGINE STARTING DEVICE

[76] Inventor: M. C. Bennett, Sr., Rte. 1, Box 587-A, Fort Worth, Tex. 76135

[21] Appl. No.: 188,316

[22] Filed: Sep. 18, 1980

[51] Int. Cl.[3] ..... F02N 11/12

[52] U.S. Cl. ..... 123/179 SE; 74/6

[58] Field of Search ..... 123/179 SE, 185 R, 185 D; 74/6, 550; 64/4

[56] References Cited

U.S. PATENT DOCUMENTS

| | | | |
|---|---|---|---|
| 2,804,957 | 9/1957 | Pechin, Jr. | 123/179 SE |
| 2,816,535 | 12/1957 | Sells | 123/179 SE |
| 2,901,911 | 9/1959 | Duncan | 123/179 SE |
| 3,040,854 | 6/1962 | Rauh | 123/179 SE |
| 3,394,598 | 7/1968 | Hoch | 74/6 |
| 3,537,436 | 11/1970 | Heisler | 123/179 SE |
| 3,596,647 | 8/1971 | Heisler | 123/179 SE |
| 3,885,544 | 5/1975 | Pfeiffer | 123/179 SE |

*Primary Examiner*—Charles J. Myhre
*Assistant Examiner*—Andrew M. Dolinar
*Attorney, Agent, or Firm*—Robert A. Felsman

[57] ABSTRACT

A quick release starting device for internal combustion engines having a rotary crankshaft is shown. The device includes a case, a sliding shaft vertically disposed within the case, and a compression spring mounted about the shaft inside the case. An exchangeable socket is mounted on the lower end of the shaft to engage the engine crankshaft. Downward pressure on the sliding shaft compresses the spring and engages the socket. When the engine starts and pressure is removed from the shaft, the spring tension is released thereby assisting the operator in disengaging the socket from the crankshaft.

3 Claims, 3 Drawing Figures

ENGINE STARTING DEVICE

BACKGROUND OF THE INVENTION

This invention relates generally to quick release starting devices for internal combustion engines having a rotary crankshaft.

Many small internal combustion engines such as lawn mower engines are started by means of a pull-type mechanism in which a rope is wound about a pulley which is affixed to the crank shaft of the engine. Starting the engine can require tremendous physical exertion especially if the engine components are in less than optimum condition. Many times the task is beyond the capacity of those persons having weaker physical constitutions due to high blood pressure, heart conditions, or the like. For this reason mechanically or electrically operated starters have been utilized.

Such prior art devices have included expensive and complex power starting units such as those utilizing a starter ring and Bendix drive with an electric starter and battery. Although these units work satisfactorily, they greatly increase the initial cost of the lawn mower and are beyond the means of many people. In an attempt to devise a more economically feasible starter, prior proposals have suggested using a coupler to connect an electric drill to the crankshaft to provide the torque needed to turn the crankshaft. Certain of these devices have proved to be hazardous to operate due to the difficulty in disengaging the coupler from the engine once the engine is started. Certain embodiments also required a special mounting structure on the lawn mower which required modifying the existing crankshaft configuration.

BRIEF SUMMARY OF THE INVENTION

The present starter for internal combustion engines of the type having a rotary crankshaft has a quick release feature to disengage the starter from the engine crankshaft once the engine has started. The starter includes a portable case with tapered interior walls and a shaft disposed within the case for movement along its vertical axis. The shaft has an upper end which protrudes from the case and is adapted to be chucked in a power drill and a lower end generally confined within the case. An exchangeable socket is mounted on the lower end of the shaft to engage the rotary crankshaft of the engine which is to be started.

A compression spring is mounted between a fixed spring retainer and sliding spring retainer on the shaft within the case and is movable between a compressed position and a relaxed position. Downward pressure on the upper end of the shaft compresses the spring and engages the socket on the crankshaft. When the downward pressure is removed, as when the engine starts, the compression spring returns to the relaxed position thereby disengaging the socket from the crankshaft. The exchangeable socket allows the device to be adapted to a variety of crankshaft sizes without the necessity of special mounting structures.

DETAILED DESCRIPTION OF THE INVENTION

Figure 1:
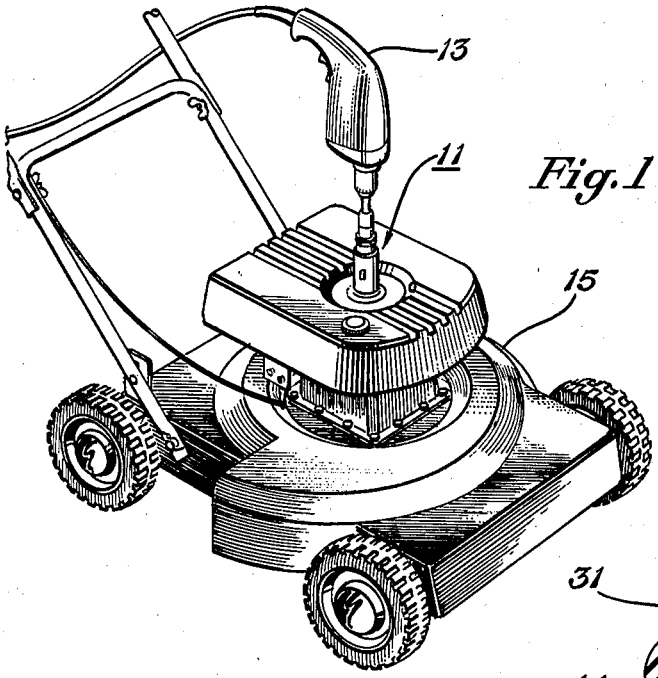
FIG. 1 is a perspective view of the quick release starting device in place on a lawn mower engine.
Figure 3:
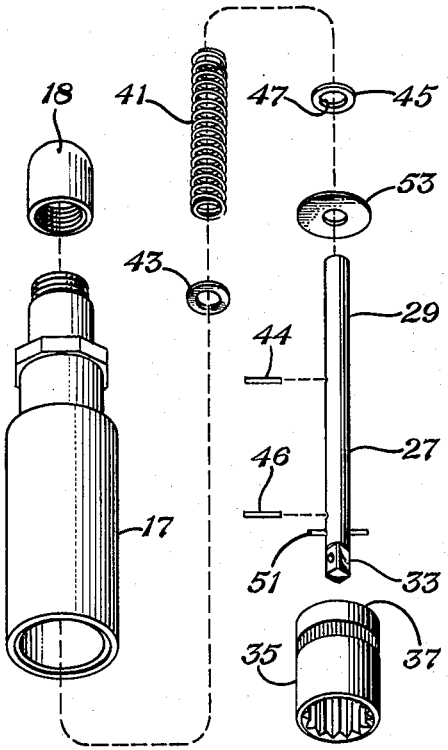
FIG. 3 is an exploded perspective view of the device of FIG. 1 showing the parts contained therein.

Referring now to FIG. 1, there is shown a quick release starting device of the present invention denoted generally as 11. The starting device 11 is chucked in a conventional power drill 13 of the kind commonly found in garages and workshops. The starting device 11 is mounted on the rotary crankshaft of an internal combustion engine such as that of a gasoline powered lawn mower 15.

Figure 2:
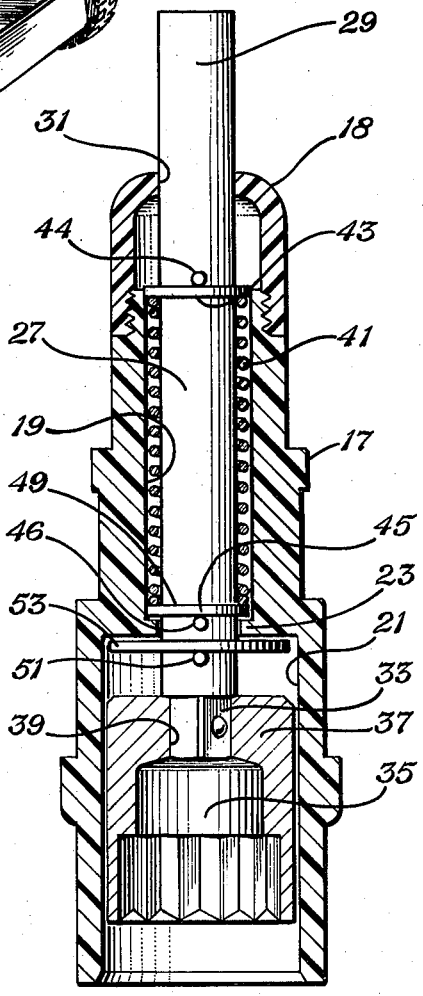
FIG. 2 is a side cross-sectional view of the device of FIG. 1.

The quick release starting device 11 is shown in greater detail in FIG. 2 and includes a portable case 17, preferably molded from lightweight plastic. A threaded top 18 provides easy access to the interior of the device and facilitates its assembly and disassembly. Case 17 has tapered interior sidewalls 19, said sidewalls forming a recess 21 of greater internal diameter and having an upper shoulder 23.

A sliding shaft 27 is vertically disposed within case 17 for movement along the vertical axis thereof. Shaft 27 has an upper exposed end 29 which protrudes from an opening 31 in the top of case 17 and a lower end 33. Exposed end 29 is adapted to be chucked in a power drill. Lower end 33 is polygonal in shape and preferably square.

A coupling means including an exchangeable socket 35 is mounted on the lower end of shaft 27 to engage the rotary crankshaft of the engine to be started. Socket 35 has a closed bottom 37 having a polygonal recess 39 for engaging lower end 33 of shaft 29.

Biasing means including a compression spring 41, a fixed spring retainer 43, and a sliding spring retainer 45 are provided to engage the coupling means and rotary crankshaft when pressure is applied to the upper exposed end 29 of sliding shaft 27 and for quickly disengaging case 17, shaft 27, and socket 35 from the rotary crankshaft when the pressure is removed.

Fixed spring retainer 43 is affixed to the upper end 29 of shaft 27 at a point on shaft 27 located within case 17. Fixed spring retainer 43 can conveniently be a washer inserted below a pin 44 as shown in FIG. 2, it being understood that a snap ring or like retaining structure could also be used for this purpose. Compression spring 41 is mounted about shaft 27 within case 17 below fixed spring retainer 43. Compression spring 41 is preferably a steel helical coil spring.

A sliding spring retainer such as washer 45 is fitted on the lower end of shaft 27 below compression spring 41 and above pin 46. The internal diameter of the opening 47 in washer 45 is selected to allow the shaft 27 to pass within the opening but to retain compression spring 41 on the upper washer surface 49.

The external diameter of washer 45 is selected to allow the washer to slide along shaft 27 within the interior sidewalls 19 of case 17 but to be retained on upper shoulder 23.

Compression spring 41 is movable between a compressed position when the upper exposed end 29 of shaft 27 is depressed and the coupling means are engaged and a relaxed position when the pressure is removed and the coupling means are disengaged.

A keeper assembly including a pin 51 and washer 53 are preferably affixed to shaft 27 between sliding spring retainer 45 and exchangeable socket 35, as shown in FIG. 2. Pin 51 and washer 53 prevent exchangeable socket 35 from being "popped off" the lower end 33 of shaft 27 when downward pressure is removed from upper end 29 and the release of spring tension moves shaft 27 and socket 35 upward.

In operation, the upper exposed end 29 of shaft 27 is first chucked in a standard electrical power drill. The lower end 33 of starting device 11 is then positioned over the exposed rotary crankshaft of the device to be started.

On certain engines, the crankshaft may be directly accessible to the quick starting device. In other cases, it may be necessary to remove a cover plate thereby exposing the upper end of the crankshaft while leaving the pull-start mechanism intact.

The starter is coupled to the engine crankshaft by pressing down on exposed end 29 of shaft 27. Downward movement of shaft 27 engages exchangeable socket 35 on the end of the crankshaft which protrudes above the engine. Downward pressure on upper end 29 also wedges the sliding spring retainer 45 on shoulder 23 of tapered walls 19. Continued downward movement of upper end 29 compresses spring 41 between sliding spring retainer 45 and fixed spring retainer 43.

Torque is applied to upper end 29 by turning on power drill 13. Torque is transmitted through shaft 27 and exchangeable socket 35 to the crankshaft to start the engine. When the engine starts, downward pressure is removed from shaft 27. Compression spring 41 returns to the relaxed position simultaneously disengaging the exchangeable socket 35 from the crankshaft.

It should be apparent that an invention has been provided with significant advantages. The quick release device of the present invention allows an internal combustion engine having a rotary crankshaft to be started quickly and conveniently without great physical exertion. The improved starter can be manufactured at a fraction of the cost of the electric starter and battery systems. The quick release feature allows quick disengagement of the starting unit from the engine once the engine has started, thereby lessening the chance of accidental injury to the operator. The exchangeable socket feature allows the starter to be adapted to a variety of crankshaft sizes. No special mounting structure on the engine is required.

While it is apparent the invention has been shown in only one of its forms, it should be apparent to those skilled in the art that it is not so limited but is susceptible to various changes and modifications without departing from the spirit thereof.

I claim:

1. A quick release starting device for an internal combustion engine having a rotary crankshaft, comprising:

a portable case having interior sidewalls, said interior sidewalls having a shoulder formed therein;

a sliding shaft vertically disposed within said case, said shaft having an upper exposed end adapted to be chucked in a power drill and a lower end;

coupling means mounted on the lower end of said shaft for engaging said rotary crankshaft;

a compression spring mounted about said sliding shaft in said case;

a fixed spring retainer affixed to the upper end of said sliding shaft above said compression spring located within said case;

a sliding spring retainer fitted on the lower end of said shaft below said compression spring and above said coupling means, said sliding spring retainer having an opening therein selected to allow said sliding shaft to pass within said opening but to retain said compression spring; and said sliding spring retainer being engagable with said shoulder formed in the interior sidewalls of said case and said case being engagable with said engine so that said spring is compressed between said fixed and sliding spring retainers when downward pressure is applied on the upper exposed end of said shaft to engage said coupling means and cause said shaft to slide through said sliding spring retainer opening and said spring being relaxed when said pressure is removed to disengage said coupling means.

2. A quick release starting device for an internal combustion engine having a rotary crankshaft, comprising:

a portable case having interior sidewalls said interior sidewalls having a shoulder formed therein;

a sliding shaft vertically disposed within said case, said shaft having an upper exposed end adapted to be chucked in a power drill and a lower end;

an exchangeable socket mounted on the lower end of said shaft for engaging said rotary crankshaft;

a compression spring mounted about said sliding shaft in said case;

a fixed spring retainer afixed to the upper end of said sliding shaft above said compression spring located within said case;

a sliding spring retainer fitted on the lower end of said shaft below said compression spring and above said coupling means, said sliding spring retainer having an opening therein selected to allow said sliding shaft to pass within said opening but to retain said compression spring; and said sliding spring retainer being engagable with said shoulder formed in the interior sidewalls of said case and said case being engagable with said engine so that said spring is compressed between said fixed and sliding spring retainers when downward pressure is applied on the upper exposed end of said shaft to engage said exchangeable socket and cause said shaft to slide through said sliding spring retainer opening and said spring being relaxed when said pressure is removed to disengage said exchangeable socket.

3. A quick release starting device for an internal combustion engine having a rotary crankshaft, comprising:

a portable case having tapered interior sidewalls, said interior sidewalls having a shoulder formed therein;

a sliding shaft vertically disposed within said case for movement along the vertical axis thereof, said shaft having an upper exposed end and a lower end and said shaft being fitted with a fixed spring retainer at the upper end and a sliding spring retainer at the lower end;

a compression spring mounted about said shaft within said case, said spring being positioned between said upper fixed spring retainer and said lower sliding spring retainer;

an exchangeable socket mounted on the lower end of said shaft for directly engaging said rotary crankshaft when said spring is compressed;

said sliding spring retainer having an opening therein selected to allow said sliding shaft to pass within said opening but to retain said compression spring and said sliding spring retainer being engagable with said shoulder formed in the interior sidewalls of said case and said case being engagable with said engine so that said spring is compressed between said fixed and sliding spring retainers when downward pressure is applied on the upper exposed end of said shaft to engage said exchangeable socket and cause said shaft to slide through said sliding spring retainer opening and said spring being relaxed when said pressure is removed to disengage said exchangeable socket; and a keeper assembly fitted to said lower end of said shaft below said sliding spring retainer to prevent contact between said exchangeable socket and said tapered interior walls as downward pressure is removed from said shaft.

* * * * *